United States Patent [19]

Phillips

[11] Patent Number: 4,531,330

[45] Date of Patent: Jul. 30, 1985

[54] BED/SHELTER UNIT

[76] Inventor: William E. Phillips, 6015 Varna Ave., Van Nuys, Calif. 91401

[21] Appl. No.: 344,748

[22] Filed: Feb. 1, 1982

[51] Int. Cl.[3] ..... A47C 27/08; A45F 1/02; A45F 1/00

[52] U.S. Cl. ..... 52/2; 5/414; 5/454; 135/116

[58] Field of Search ..... 5/414, 413, 453, 454; 52/2; 135/116, 87, 104, 106

[56] References Cited

U.S. PATENT DOCUMENTS

| | | | |
|---|---|---|---|
| 1,733,034 | 10/1929 | Tufenkjian | 52/2 |
| 2,068,134 | 1/1937 | Houghton | 5/454 |
| 2,369,736 | 2/1945 | Hurt | 5/454 |
| 2,656,844 | 10/1953 | Kreuzer . | |
| 2,754,836 | 7/1956 | Darby | 52/2 |
| 2,830,606 | 4/1958 | Daugherty . | |
| 2,875,771 | 3/1959 | Brewin | 52/2 |
| 3,042,941 | 7/1962 | Marcus | 5/454 |
| 3,063,620 | 11/1962 | Black | 417/478 |
| 3,068,494 | 12/1962 | Pinkwater | 5/454 |
| 3,112,502 | 12/1963 | Forsberg | 5/454 |
| 3,155,991 | 11/1964 | Dunham | 5/454 |
| 3,457,684 | 7/1969 | Wood | 52/2 |
| 3,751,741 | 8/1973 | Hendry | 5/121 |
| 3,840,919 | 10/1974 | Middleton . | |
| 3,899,853 | 8/1975 | Wertman | 52/2 |
| 4,000,585 | 1/1977 | Denaro | 52/2 |
| 4,197,681 | 4/1980 | Holcombe | 52/2 |
| 4,271,642 | 6/1981 | Karr | 52/2 |
| 4,332,112 | 6/1982 | Hsu | 52/2 |

FOREIGN PATENT DOCUMENTS

| | | | |
|---|---|---|---|
| 87505 | 7/1966 | France . | |
| 2481589 | 6/1981 | France . | |
| 645194 | 9/1962 | Italy | 52/2 |
| WO82/03001 | 9/1982 | PCT Int'l Appl. . | |
| 623469 | 6/1981 | Switzerland | 52/2 |
| 6820152 | 4/1980 | Taiwan . | |
| 6823010 | 3/1981 | Taiwan . | |
| 6926091 | 8/1981 | Taiwan . | |
| 6820152 | 12/1981 | Taiwan . | |
| 925673 | 5/1963 | United Kingdom . | |
| 2043737 | 10/1980 | United Kingdom | 52/2 |

*Primary Examiner*—Alexander Grosz

*Attorney, Agent, or Firm*—Morgan, Finnegan, Pine, Foley & Lee

[57] ABSTRACT

A bed/shelter unit comprising a lightweight air mattress and a lightweight tent on the mattress adapted to be erected as a shelter over the mattress and to be collapsed on the mattress, the mattress, when deflated, and the tent, when collapsed on the mattress, being adapted to be compactly packed as by rolling them up into a lightweight bundle. The tent comprises a panel of lightweight flexible tent material adapted to arch over the inflated mattress from one side thereof to the other, the panel having inflatable arches at its ends adapted when inflated to extend over the mattress from one side to the other. End closures at the ends of the tent hold the arches in an erected position with the panel drawn between the arches and thereby arched over the mattress.

25 Claims, 16 Drawing Figures

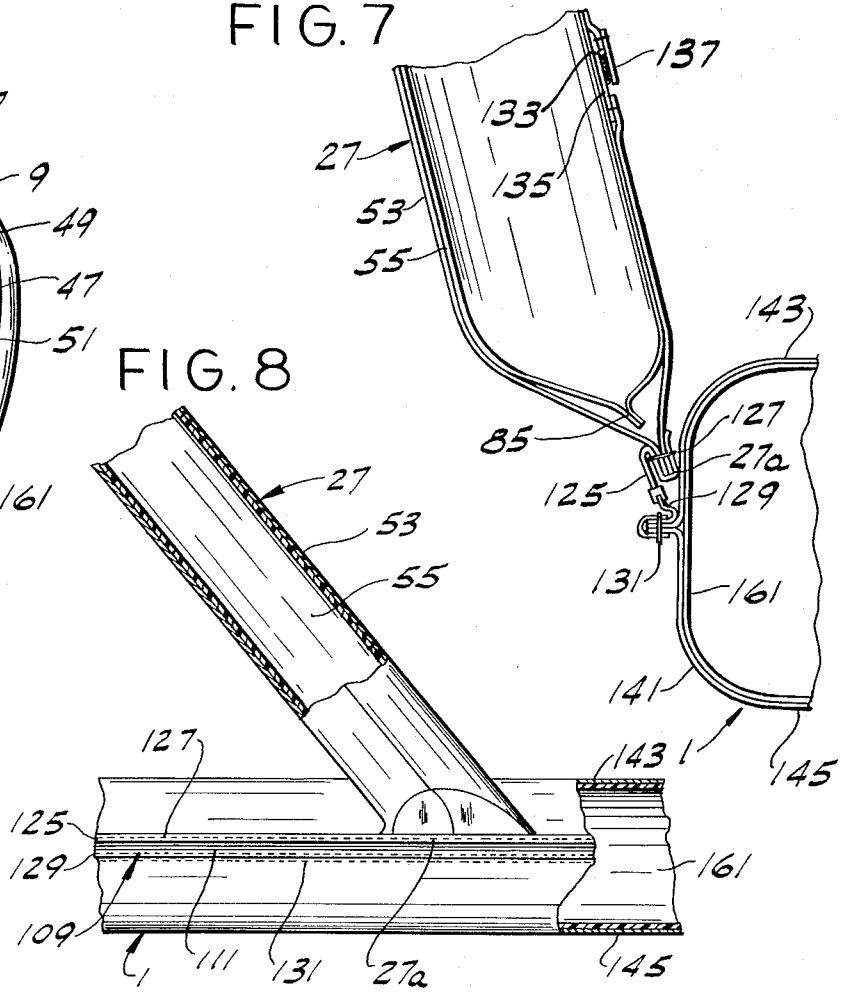
FIG. 7
FIG. 8
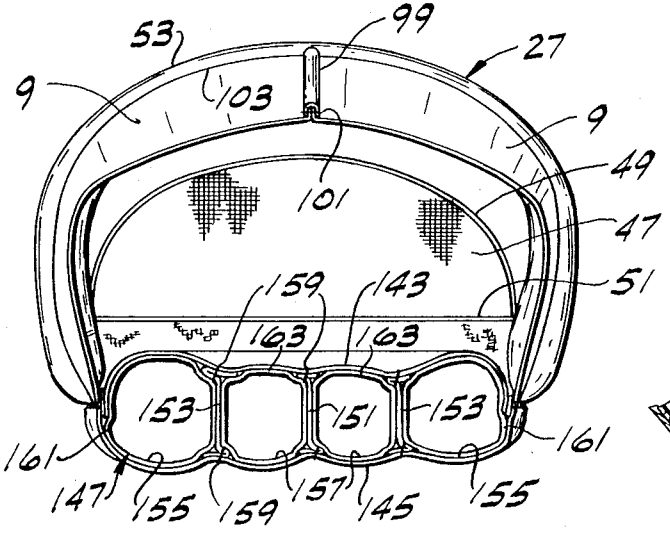
FIG. 6
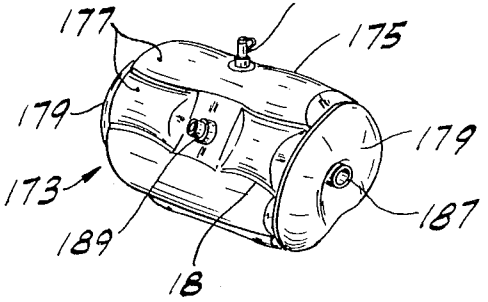
FIG. 9

BED/SHELTER UNIT

BACKGROUND OF THE INVENTION

This invention relates to what may be succinctly referred to as a bed/shelter unit, and more particularly to such a unit for recreational, military or other uses comprising an air mattress adapted to be inflated and deflated and a tent adapted to be erected as a shelter over the mattress and to be collapsed on the mattress for packing of the unit.

The unit may also comprise a sleeping bag on the mattress.

Reference may be made to U.S. Pat. Nos. 2,656,844, 2,830,606, 3,457,684, 3,840,919, 3,899,853 and 4,000,585 showing items generally in this field this invention involving improvements thereover.

SUMMARY OF THE INVENTION

Among the several objects of the invention may be noted the provision of a bed/shelter unit for recreational, military or other uses comprising an air mattress and a tent on the mattress adapted to be erected as a shelter over the mattress and to be collapsed on the mattress with the mattress, when deflated, and the tent, when collapsed on the mattress, being adapted to be readily compactly packed as by rolling them up into a bundle; the provision of such a unit which may have a sleeping bag on the mattress adapted to be rolled up with the mattress and tent; the provision of such a unit which is relatively light in weight and which, as packed, may be readily carried, as by back-packing; the provision of such a unit adapted for relatively easy and rapid inflation of the mattress, utilizing a collapsible air pump incorporated in the mattress, the pump itself being inflatable from a collapsed state, for compact packing of the unit, to an expanded state for pumping air for inflating the mattress, the pump when inflated also acting as part of the mattress to fill it out; the provision of such a unit wherein the tent is adapted to be erected on the mattress and held erect without any separate tent frame members and without requiring any ground connections; the provision of such a unit adapted for addition of a fly to provide a double-walled construction for thermal insulation purposes; the provision of such a unit wherein the tent is detachably secured to the mattress for ready entry and exit of the user, with the arrangement such as to enable the user to re-secure the tent to the mattress from within the tent after entry, and to enable complete detachment of the tent from the mattress for use of the mattress, e.g. as a raft, without the tent; the provision of such a unit which is insect and vermin proof; and the provision of such a unit which is relatively economical to manufacture and constitutes what may be termed a life support system for use by back packers in wilderness areas and use by military personnel in the field to provide for sleep and shelter, also for flotation at sea for life saving purposes, etc.

Generally, a bed/shelter unit of this invention comprises an air mattress adapted to be inflated and deflated, and a tent on the mattress adapted to be erected as a shelter over the mattress and to be collapsed on the mattress. The mattress, when deflated, and the tent, when collapsed on the mattress, are adapted to be compactly packed as by rolling them up into a bundle. The tent comprises a panel of flexible tent material adapted to arch over the inflated mattress from one side of the mattress to the other, this panel having lower side edges secured to the mattress at the sides of the mattress. The lower side edges of the panel terminate short of the ends of the mattress so that the mattress has end portions at both its ends extending beyond said lower edges. The panel has means at its ends adjacent the ends of the mattress adapted to be erected as arches extending over the mattress from one side of the mattress to the other, with the lower ends of the arches spaced inwardly from the ends of the mattress. Means extending between the arches and said end portions of the mattress holds the arches in an erected position with the panel drawn between the arches and arched over the inflated mattress.

Other objects and features will be in part apparent and in part pointed out hereinafter.

BRIEF DESCRIPTION OF THE DRAWINGS

FIG. 6 is a vertical transverse section of the unit generally on line 6—6 of FIG. 1;

FIG. 7 is an enlarged fragmentary section generally on line 7—7 of FIG. 1;

FIG. 8 is an enlarged fragment of FIG. 1 with parts omitted and parts broken away and shown in section;

FIG. 9 is a perspective of an air pump used in the unit;

Corresponding reference characters indicate corresponding parts throughout the several views of the drawings.

DESCRIPTION OF THE PREFERRED EMBODIMENT

Figure 1:
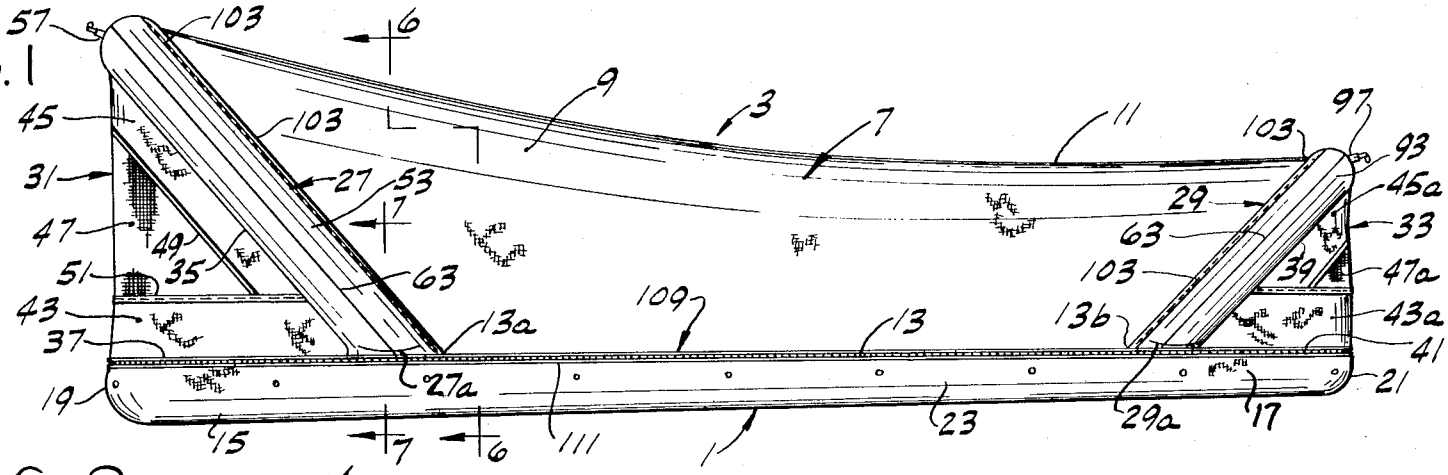
FIG. 1 is a side elevation of a bed/shelter unit of this invention as it appears when erected.

Referring to the drawings, a bed/shelter unit of this invention is shown to comprise an air mattress 1 which is adapted to be inflated and deflated, and a tent 3 on the mattress adapted to be erected as a shelter over the mattress and to be collapsed on the mattress. The unit may further comprise a sleeping bag such as indicated in phantom at 5 on the mattress. The mattress, when deflated, the tent, when collapsed on the mattress, and the sleeping bag are adapted to be compactly packed as by rolling them up into a bundle. The mattress and tent are made of relatively lightweight material and are of lightweight construction, as will appear, and a lightweight sleeping bag may be used, so that the bundle is relatively lightweight for being readily carried by campers and military personnel, e.g., being readily backpacked. An embodiment of the invention, comprising the mattress, tent and sleeping bag, has been so made as to weigh only about eight lbs., and to be capable (with the mattress deflated and the tent collapsed on the mattress over the sleeping bag) of being rolled up into a generally cylindrical bundle having a diameter of about ten inches and a length of about thirteen inches.

The tent comprises a relatively thin, lightweight roof and sidewall forming panel 7, constituted by a singleply panel herein illustrated as made of two pieces 9 of relatively thin, lightweight flexible tent fabric material seamed at 11, adapted to arch over the inflated mattress from one side of the mattress to the other. The material may be a polyurethane-coated 70–90 denier nylon material, for example. The panel 7 has straight lower side edges indicated at 13 detachably secured to the mattress at the sides of the mattress, these lower side edges 13 of the panel terminating short of the ends of the mattress as indicated at 13*a* and 13*b* so that the mattress has end portions at both its ends extending outwardly beyond said lower side edges 13, these end portions being indicated at 15 and 17 in FIG. 1. The unit as shown is a one-person unit, the mattress as inflated generally being about eight feet long, for example, and preferably being tapered in plan from one end 19 constituting its head end to its other end 21 constituting its foot end. As inflated, it may be about thirty-four inches wide at its head end and about twenty-two inches wide at its foot end, for example. End portion 15 of the mattress is at the head end, 17 at the foot end.

Figure 2:
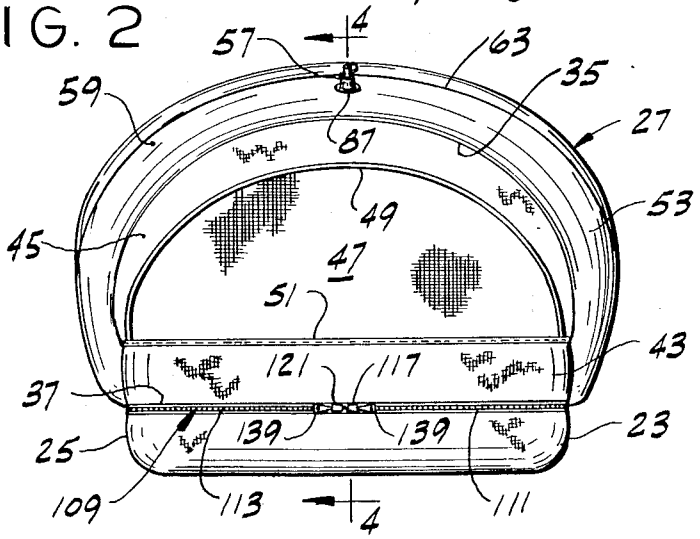
FIG. 2 is a left end elevation of FIG. 1 showing the head end of the unit.
Figure 3:
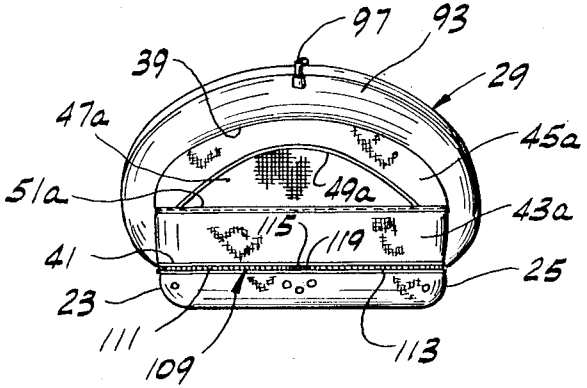
FIG. 3 is a right end elevation of FIG. 1 showing the foot end of the unit.

The panel 7 has means at its ends adapted to be erected as arches extending over the mattress from one side 23 (the right side) to the other side 25 (the left side) of the mattress for holding the panel up over the mattress. These two end arches are designated 27 and 29, 27 being toward the head end and 29 toward the foot end. The head end arch 27 is larger than the foot end arch 29. The lower ends 27*a* of the two legs of the head end arch 27 are spaced inwardly from the head end of the mattress, and the lower ends 29*a* of the two legs of the foot end arch are spaced inwardly from the foot end of the mattress (see FIGS. 1 and 4). Means indicated at 31 extending between the head end arch 27 and the extending head end portion 15 of the mattress acts as a tension member to hold the arch 27 in its erected position of FIGS. 1, 2 and 4, and means indicated at 33 extending between the foot end arch 29 and the extending foot end portion 17 of the mattress acts as a tension member to hold the arch 29 in its erected position of FIGS. 1, 3 and 4, with the panel 7 drawn (pulled) between the end arches and thereby arched over the inflated mattress from side to side of the mattress as appears in FIG. 6.

Means 31 is an end closure for the head end of the tent; means 33 is an end closure for the foot end of the tent. The head end closure 31 has a curved edge secured to head end arch 27 at 35, and a lower straight edge indicated at 37 which in effect forms a continuation of the lower side edges 13 of panel 7 extending from the right side 23 of the mattress around the head end 19 of the mattress to the left side 25 of the mattress and secured to the mattress. Similarly, the foot end closure 33 has a curved edge secured to the foot end arch 29 at 39 and a lower straight edge indicated at 41 which in effect forms a continuation of the lower side edges 13 of panel 7 (and the lower edge 37 of head end closure 31) extending from the right side 23 of the mattress around the foot end of the mattress to the left side 25 of the mattress and secured to the mattress.

The head end closure 31 comprises a lower section 43 of lightweight tent fabric material (e.g., the same material as the panel 7) extending from the right leg of the head end arch 27 along the right side of the mattress, around the head end of the mattress to the left side of the mattress, and along the left side of the mattress to the left leg of the arch 27, an upper section 45 of tent fabric material in the shape of a crescent secured at its top and sides as indicated at 35 to the arch 27, and an intermediate section or insert 47 of netting (for purposes of ventilation while excluding insects and vermin) having a curved edge 49 secured to the upper section 45 and a straight lower edge 51 secured to the upper edge of section 43. The foot end closure 31 comprises a lower section 43*a* of tent fabric material corresponding to 43 extending from the right leg of the foot end arch 29 along the right side of the mattress, around the foot end of the mattress to the left side of the mattress, and along the left side of the mattress to the left leg of the arch 27, an upper section 45*a* of tent fabric material corresponding to 45 in the shape of a crescent secured at its top and sides as indicated at 35 to the arch 29, and an intermediate section or insert 47*a* of netting corresponding to 47 having a curved edge 49*a* secured to the upper section 45*a* and a straight lower edge 51*a* secured to the upper edge of the lower section 43*a*. Each end closure is in the form of a skirt of tent fabric material secured (at the top and sides) to the respective end arch, draped around the respective end portion 17 or 19 of the mattress, and having an opening therein with netting (47, 47*a*) in the opening.

Figure 4:
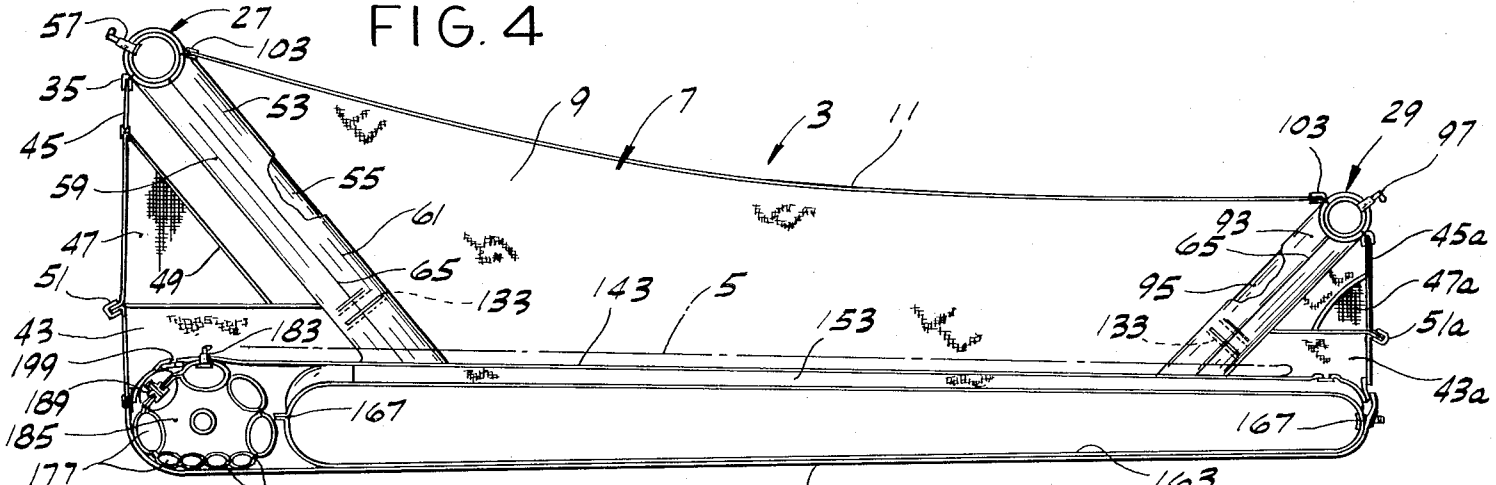
FIG. 4 is a central vertical longitudinal section of the unit on line 4—4 of FIG. 2.

The head end closure 31 (as secured to the mattress) holds the head end arch 27 in the inclined position shown in FIGS. 1 and 4 slanting upward and outward from the lower ends 27*a* of the legs of the arch in the direction toward the head end of the mattress. Arch 27, in its stated inclined position, has its top or peak located generally above the head end 19 of the mattress, and the head end closure 31 extends generally vertically downwardly from the arch 27 and surrounds the upper part of end portion 15 of the mattress. Similarly, the foot end closure 33 (as secured to the mattress) holds the foot end arch 29 in the inclined position shown in FIGS. 1 and 4 slanting upward and outward from the lower ends 29*a* of the arch 29 in the direction toward the foot end of the mattress. Arch 29, in its stated inclined position, has its top or peak located generally above the foot end 21 of the mattress, and the foot end closure extends generally vertically downwardly from the arch 29 and surrounds the upper part of end portion 17 of the mattress.

Figure 10:
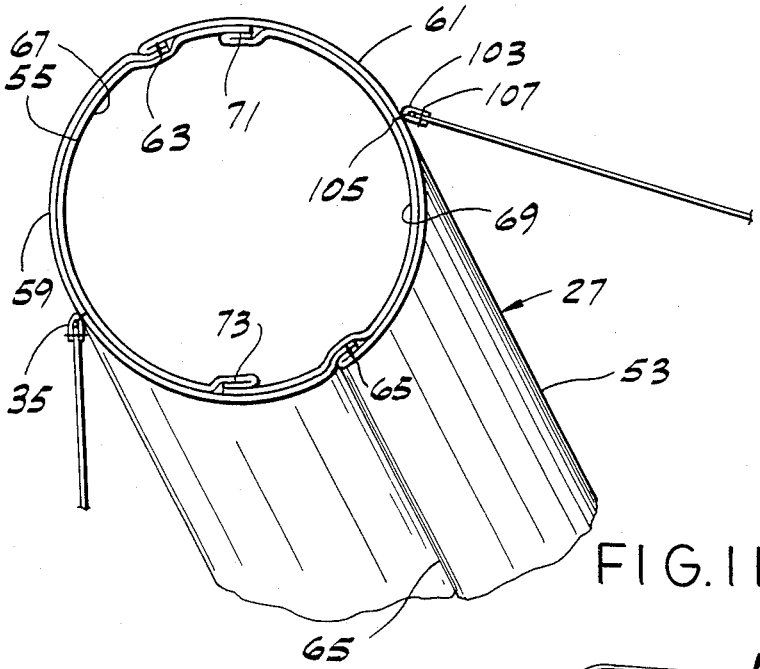
FIG. 10 is an enlarged fragment of FIG. 4.
Figure 11:
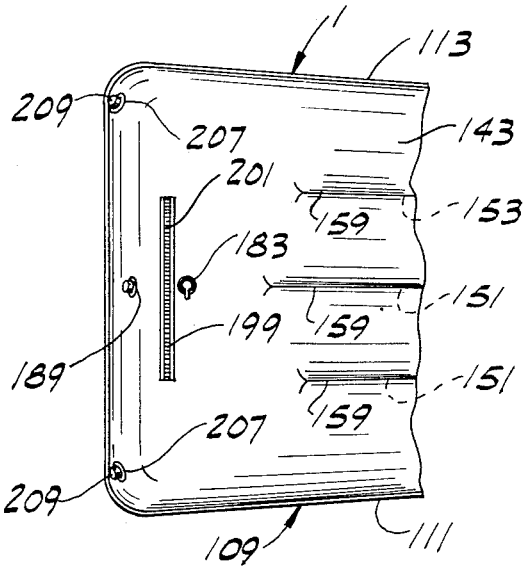
FIG. 11 is an unbroken top plan of the right end of the mattress.

The head end arch 27 comprises a tubular envelope or casing 53 of tent fabric material, e.g. polyurethane-coated 200 denier nylon fabric (like panel 7), and inflatable bladder means 55 in the tubular casing, with a fitting 57 for inflating and deflating the bladder means. The tubular casing is made of two strips 59 and 61 of the fabric material each having the shape of an arch (i.e. generally of inverted U or horseshoe shape) superimposed one on the other and seamed by stitching along their edges at the outside of the arch as indicated at 63 and along their edges at the inside of the arch as indicated at 65 to form the tubular casing in the shape of an arch of the size and shape for the head end arch. As appears in FIG. 10, the seams at 63 and 65 are inturned (by everting the sewn-together strips). The lower ends at 27*a* of the legs of the arch-shaped tubular casing 53 are cut on lines extending diagonally with respect to the casing so that the casing, as secured at its lower ends to the mattress and when erected, slants upward and outward from its lower ends in the direction toward the head end of the mattress.

Figure 12:
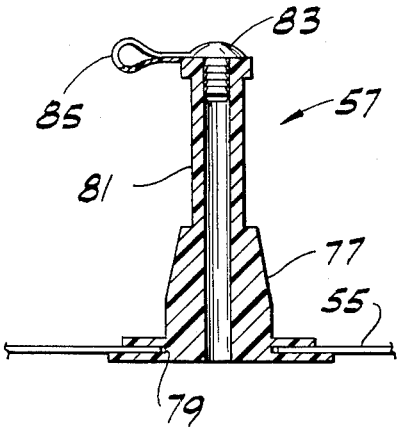
FIG. 12 is a section of an inflation and deflation fitting used in the unit.

The bladder means 55 in the casing 53 of the head end arch 27 comprises an inflatable tube also made in the shape of an arch by being formed of two arch-shaped (horseshoe-shaped) strips 67 and 69 of heat-sealable air impermeable plastic film such as 3 mil polyurethane film superimposed one on the other and heat-sealed along their edges on the outside and inside of the arch as indicated at 71 and 73 to form a tube curved in the shape of the head end arch. The ends of the tube are closed as indicated at 85 by heat-sealed seams. As shown in FIG. 12, the fitting 57 comprises a tubular body 77 of rubber or the like secured in an opening 79 in the inflatable tube 55 having a tubular stem 81 adapted to be pinched closed by the thumb and forefinger, and a plug 83 for the outer end of the stem on a tether 85. The plug is removable for inflating the tube 55 by mouth, the stem being pinched closed to maintain the inflation while the plug is applied, the plug then holding air in the tube. The fitting 57 is located at the peak of the arch extending through an opening 87 in the casing 53 in the direction toward the head end of the unit.

The foot end arch 29 similarly comprises a tubular casing 93 of the same material as the head end arch 27 and inflatable bladder means 95 in the casing, with a fitting 97 for inflating and deflating the bladder means. The casing 93 is made of two strips in the same manner as the casing 53, and the bladder means 95 is an inflatable tube made of two strips in the same manner as the inflatable tube 55, but the casing and tube are shorter in overall length around the arch than the casing 53 and tube 55. The fitting 97 is the same as the fitting 57, being located at peak of the arch 29 extending through an opening in the casing 93 in the direction toward the foot end of the unit.

As noted above, the panel 7 comprises two sheets 9 of fabric material seamed together at 11. This seam is made by folding a bias-cut strip 99 of suitable fabric, which may be the same as that of the sheets 9 of the panel, around registered edges of the sheets and stitching as indicated at 101 in FIG. 6. The seam extends upwardly from panel 7 along what may be considered the longitudinal center line of the panel, and constitutes a ridge for the tent as it is erected over the mattress sheltering the seam. The casings 53 and 93 of the end arches 27 and 29 are seamed to the end edges of the panel 7 (or vice versa) by means of bias-cut strips 103 of fabric, which may be the same as that of the sheets of the panel, stitched to the casings as indicated at 105, and folded around the end edges of the panel and stitched thereto as indicated at 107. The end closures 31 and 33 are similarly seamed at 35 and 39 to the casings of the end arches.

The tent 3, comprising the panel 7, arches 27 and 29 and end closures or skirts 31 and 33, is detachably secured to the mattress 1 all around the mattress by slide fastener means generally indicated at 109. As shown, this slide fastener means preferably comprises two slide fasteners rather than one, viz. a right-hand slide fastener 111 and a left-hand slide fastener 113. The right-hand slide fastener 111 is a two-way separating slide fastener extending from its starting end indicated at 115 in FIG. 5 adjacent the center of the foot end 21 of the mattress to the right side 23 of the mattress, along the right side of the mattress to the head end 19 of the mattress, and along the head end to its other end 117 adjacent the center of the head end. The left-hand slide fastener is also a two-way separating slide fastener extending from its starting end indicated at 119 in FIG. 5 adjacent the center of the foot end to the left side 25, along the left side to the head end, and along the head end to its other end indicated at 121 adjacent the center of the head end. The right-hand slide fastener 111 comprises an upper tape 125 seamed by stitching as indicated at 127 to the right-hand half of the lower edge of end closure 31, the lower end of the right-hand leg of the head end tubular arch casing 53, the right-hand lower edge of panel 7, the lower end of the right-hand leg of the foot end tubular arch casing 93, and the right-hand half of the lower edge of end closure 33, and a lower tape 129 seamed by stitching as indicated at 131 to the mattress extending generally from the center of the head end of the mattress to the right side of the mattress, along the right side to the foot end, and along the foot end generally to the center of the foot end. The left-hand slide fastener 123 comprises correspondingly an upper tape seamed by stitching to the left-hand half of the lower edge of end closure 31, the lower end of the left-hand leg of the head end tubular arch casing 53, the left-hand lower edge of panel 7, the lower end of the left-hand leg of the foot end tubular arch casing 93, and the left-hand half of the lower edge of end closure 33, and a lower tape seamed by stitching to the mattress extending generally from the center of the head end of the mattress to the left side of the mattress, along the left side to the foot end, and along the foot end generally to the center of the foot end. The stitching at 127 at each side provides the stated lower end closures **27*a* and 29*a* for the arch casings. The latter have openings as indicated at 133 adjacent their lower ends for insertion and removal of the inflatable arch tubes 55 and 95, these openings being shown as slits in the casings, and provided with suitable closure means such as strips 135 and 137 of releasable mating material sold under the trademark "VELCRO". The slide of each of the slide fasteners has both inside and outside pull tabs, the outside tabs being indicated at 139 in FIGS. 2 and 5**.

The air mattress 1, while primarily for use as a bed, is also useful as a raft, being capable of floating on the water. It comprises an outer casing generally designated 141 (which may also be referred to as a shell or envelope) formed of an upper sheet or ply 143 and a lower sheet or ply 145 of lightweight water-repellent fabric such as a polyurethane-coated 200 denier nylon material, these sheets being superimposed one on the other with their edges generally in register and seamed together at 131 all around their edges as by stitching. Inflatable bladder means generally designated 147 is provided in the casing adapted on inflation to expand the casing to the expanded state illustrated in FIGS. 1–7 wherein the upper and lower sheets are spaced to form the mattress top and bottom, sides 23 and 25 and ends 19 and 21.

Figure 5:
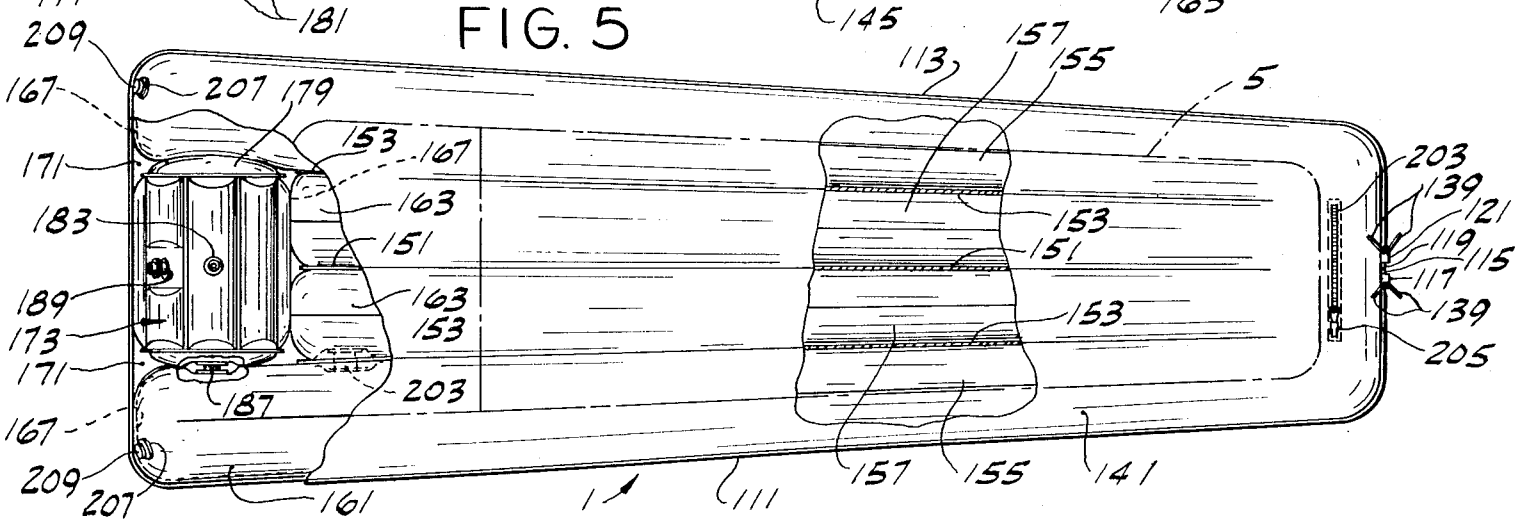
FIG. 5 is a top plan of the mattress of the unit with the tent removed and with the top of the mattress partly broken away to show interior detail.

As shown particularly in FIGS. 5 and 6, the mattress casing 141 has a central partition 151 and two outer partitions each designated 153, made of suitable material (which may be the same material as that of the sheets 143 and 145) extending lengthwise of the mattress dividing it into two outer cells each designated 155 and two intermediate cells each designated 157 extending lengthwise of the casing. These partitions are seamed to the sheets by stitching as indicated at 159. The bladder means 147 comprises four inflatable tubes, two outer tubes each designated 161 extending lengthwise in the outer cells 155, and two intermediate tubes each designated 163 extending lengthwise in the intermediate cells 157. Each of these tubes is made of 3 mil flexible polyurethane film, for example. The mattress casing 141, the partitions 151 and 153 and the tubes 161 and 163 are formed so that on inflation of the tubes, the mattress is expanded to the shape in which it appears in FIGS. 1–6, being tapered in plan from its head end 19 to its foot end 21 and also tapered in side elevation (and in longitudinal section) from its head end to its foot end. The partitions are typically about 9½ inches high at their head ends and about 5½ inches high at their foot ends. Each of the tubes is formed of a relatively long narrow tapered piece of 3 mil polyurethane film, for example, formed into a tube with a heat-sealed longitudinal seam such as indicated at 165 and with heat-sealed end seams such as indicated at 167 at their head and foot ends, respectively. Each of the two outside tubes 161 is tapered so as to have, when inflated, a diameter of about 9½ inches at the head end and a diameter of about 5½ to 6 inches at the foot end, and each of the two inside tubes 163 is tapered so as to have, when inflated, a diameter of about 8 inches at the head end and a diameter of about 4½ inches at the foot end.

The partitions 151 and 153 terminate short of the ends of the mattress. Each of the two outer tubes 161 has a length corresponding generally to the overall length of the mattress (typically about 8 feet). They extend from end-to-end of the mattress through the two outer cells 155 defined between the two outer partitions 153 and the sides of the mattress. The two intermediate tubes 163 are shorter than the outer tubes 161, each having a length greater than the distance from the head ends of the partitions 151, 153 to the foot end of the mattress, but less than the overall length of the mattress. They extend from a point located between the head end 19 of the mattress and the head ends of the partitions through the cells 157 to the foot end of the mattress.

Figure 13:
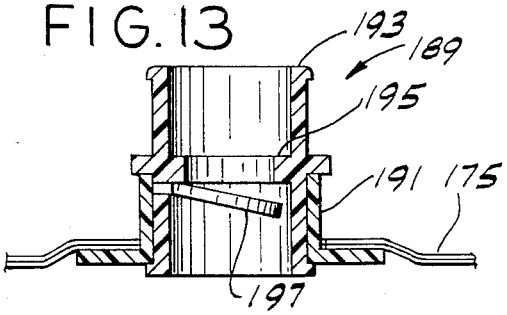
FIG. 13 is a section of a check-valved fitting used in the unit.

With the outer tubes 161 in the outer cells 155 extending all the way from the head end 19 to the foot end 21 of the mattress, and with the intermediate tubes 163 shorter than the outer tubes and extending from the foot end toward but terminating short of the head end of the mattress, a chamber or compartment 171 is provided in the mattress at its head end between the portions of the two outer tubes 161 which extend beyond the intermediate tubes 163. An inflatable pump 173 is disposed in this chamber. This pump, for complete details of which reference may be made to my copending U.S. patent application Ser. No. 317,436, filed Nov. 2, 1981, now abandoned generally comprises a tubular body 175 made of air-impervious flexible sheet material, such as 8 mil polyurethane film, having a plurality of intercommunicating inflatable air cells or chambers 177 extending lengthwise thereof and inflatable end walls 179 and the ends of the tubular body. The tubular body may be formed of two plies of film, the cells being formed by seals indicated at 181 between the layers extending lengthwise of the body and terminating somewhat short of its ends for intercommunication of the cells. The end walls are also formed of two layers of film, the space between the walls being in communication with the cells 177. A fitting 183 corresponding to fitting 57 for oral inflation and for deflation of the cells 177 and end walls 179 is provided in the outer ply of the pump body 175 generally at the center of its length in communication with one of the cells 177 for inflation by mouth of the cells and end walls to expand the pump, the pump thereby assuming the somewhat cylindrical form in which it is shown in FIGS. 4 and 9 providing a pump chamber 185 therewithin. Each end wall 179 has a check-valved outlet 187 for delivery of air from chamber 185. The arrangement is such that with the pump in its inflated expanded condition of FIGS. 4 and 9, the pump may be manually squeezed to force air from the pump chamber 185 through the check-valved outlets 187, the pump expanding back to its full expanded state upon release by the action of the inflated cells 177. The check valves in the outlets check flow of air back through the outlets to the pump chamber 185 when the pump expands on release. Air is admitted to the chamber on expansion of the pump via a check-valved air inlet 189 the valve in this inlet blocking exit of air therethrough when the pump is squeezed. The fitting 183 and air inlet 189 extend through openings in the top ply 143 of the mattress. FIG. 13 shows the inlet 189, which comprises a fitting 191 secured to the pump and a tubular insert 193 having a valve seat 195 and a flapper valve member 197 received in the fitting, with the flapper valve member adapted to open for ingestion of air for the pump and to close on the seat when the pump is squeezed. Each outlet 187 is the same except that the insert is reversely mounted in the fitting so that the flapper valve member opens when the pump is squeezed and closes on the seat when the pump is released. An opening is provided at 199 in the upper ply 143 of the mattress adjacent its head end for placing the pump in and removing it from the mattress. This opening is adapted to be closed by a slide fastener 201.

The pump 173 is placed in the chamber 171 in the mattress with the pump axis extending transversely of the mattress and with the end walls 179 of the pump at the inside of and adjacent the end portions of the outer inflatable tubes 161 projecting beyond the tubes 163 (see FIG. 5). The pump outlet 187 at the right-hand end of the pump is connected to the right-hand tube 161, and the pump outlet at the left-hand end of the pump is connected to the left-hand tube 161. The left-hand tubes 161 and 163 are interconnected as indicated at 203 for communication of air therebetween (flow of air from either one to the other), and the two right-hand tubes 161 and 163 are similarly interconnected. The tubes (when deflated) are adapted for placement in and removal from the mattress via the opening at 199, and a similar opening indicated at 203 with a slide fastener 205 may be provided adjacent the foot end of the mattress. The right-hand tubes 161 and 163 are adapted to be deflated by exit of air therefrom through an outlet fitting 207 having a removable plug 209, and the left-hand tubes 161 and 163 are adapted to be deflated by exit of air therefrom through a similar fitting. These mattress deflation fittings extend from the head ends of tubes 161 through openings in the mattress casing at the head end corners of the mattress.

The unit is set up by inflating the pump 173 to expand it for pumping air into the inflatable tubes 161 and 163 of the mattress 1, operating the pump by manually squeezing it (with the hands) to pump air into the tubes 161 and 163 for inflating them to inflate the mattress, and blowing air by mouth into the inflatable end arch tubes 55 and 95 in the end arch casings 53 and 93 via the fittings 57 and 97 to expand the end arches 27 and 29 and to cause them to assume the slanting erected position in which they are shown in FIGS. 1 and 4. On erection of the end arches, the tent panel 7 is pulled endwise by the arches and drawn between them, assuming its erected arched status extending over the mattress from one side thereof to the other. If the head end closure 31 is closed by the slide fasteners 111, 113, the latter may be separated from the outside for entry into the tent, and then pulled closed from the inside. With the slide fasteners closed and thereby holding down the end closures, the end arches are held from swinging on the mattress, and the panel 7 stays up.

For packing, end arches are deflated via fittings 57 and 97, the pump 173 is deflated via fitting 183, and the mattress is deflated via fittings 207. The pump flattens out in the mattress, the mattress flattens out, and the arches 27 and 29, panel 7 and end closures 31 and 33 flatten out on the mattress. Then, the two side portions of the mattress outward of partitions 153 may be folded over on fold lines generally extending along the lines of the partition seams, and the unit rolled up to form a generally cylindrical bundle, which may be tied up and carried as such, or placed in a suitable bag.

Figure 14:
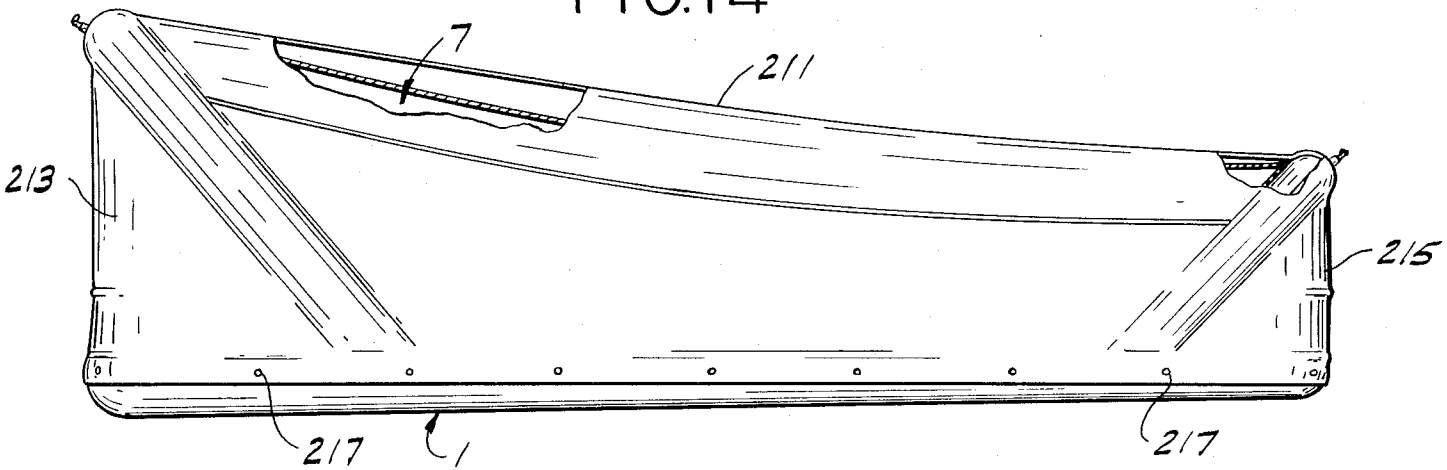
FIGS. 14–16 are views corresponding to FIGS. 1–3 showing a fly applied to the unit.
Figure 16:
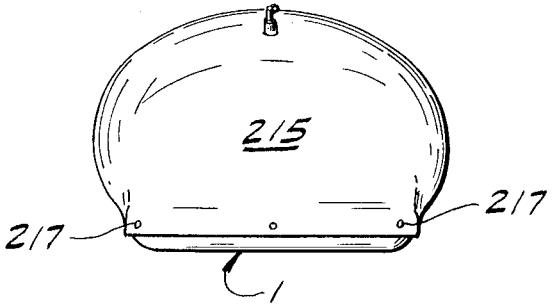
Figure 15:
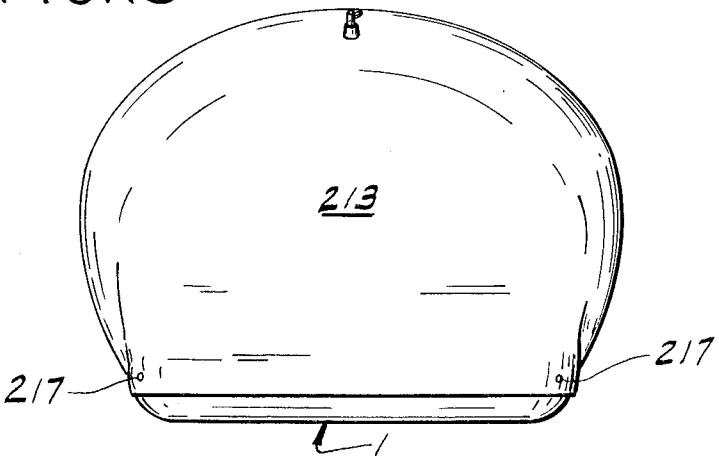

FIGS. 14–16 show a fly 211 covering the tent to provide a double-walled construction for thermal insulation purposes. The fly is constituted by a panel of tent fabric material, which may be the same as that of panel 7 draped around the tent and having end wall portions 213 and 215 extending down on the outside of end closures 31 and 33. To provide for the double-walled construction, the seams 103 joining the ends of the panel 7 to the end arches 27 and 29 are located within the outer circumferential confines of the arches, so that the fly (engaging the outer circumferences of the end arches) is held away from panel 7. The seams 35 and 39 joining the end closures 31 and 33 to the arches are located within the planes of the end faces of the arches so that the end wall portions 213 and 215 of the arches are spaced from the end closures. The fly may be buttoned down to the mattress as indicated at 217.

It will be observed that not only are the mattress, pump and tent each made of relatively lightweight material, but are also so constructed as to use a relative minimum of material so as to keep the weight down. Thus, for example, the use of panel 7 of single-ply construction between the end arches 27 and 29 and of polyurethane-coated 70–90 denier nylon (which is quite lightweight to begin with) without any arches between the end arches (i.e. with end arches only) keeps the weight down. It also contributes toward the compact packing of the unit. With the inflatable end arches 27 and 29 and end closures 31 and 33, the tent 3 is adapted to be erected on the mattress and held erect without any separate tent frame members and without requiring any ground connections (e.g., ropes and stakes), meaning that there is no need to carry any such members or connections.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A bed/shelter unit adapted to be compactly packed comprising:

an air mattress adapted to be inflated and deflated;

A tent associated with the mattress, said tent adapted to be erected as a shelter over the mattress and to be collapsed on the mattress;

said mattress, when deflated, and said tent, when collapsed on the mattress, being adapted to be compactly packed as by rolling them up into a bundle;

said tent including a panel of flexible tent material adapted to arch over the inflated mattress from one side of the mattress to the other;

said panel having lower side edges secured to the mattress at the sides of the mattress;

said lower side edges of said panel terminating short of the ends of the mattress so that the mattress has end portions at both its ends extending beyond said lower edges;

said panel having support means at each end adjacent each end of the mattress, each said support means adapted to be erected as an arch extending over the mattress from one side of the mattress to the other with each arch, at its lower ends, being spaced inwardly from its adjacent end of the mattress and sloping upwardly away from each other; and means extending between each said arch and its adjacent end portion of the mattress for holding each arch in an erected position with the panel drawn between the arches and arched over the inflated mattress without any support member extending between said arches to support said tent.

2. A bed/shelter unit as set forth in claim 1 wherein each arch, in its inclined position, has its top located generally above the respective end of the mattress.

3. A bed/shelter unit as set forth in claim 1 wherein the tent has an end closure at each end, each end closure having a curved edge secured to the respective end arch and a lower edge extending from one side of the mattress around the respective end of the mattress to the other side of the mattress.

4. A bed/shelter unit as set forth in claim 3 wherein said end closures constitute said means for holding the end arches in their erected position.

5. A bed/shelter unit as set forth in claim 4 wherein each said end closure holes the respective arch in an inclined position slanting upward and outward from the lower ends of the arch in the direction toward the respective end of the mattress, each arch, in its inclined position, having its top located generally above the respective end of the mattress.

6. A bed/shelter unit as set forth in claim 3 wherein each end closure is formed in part of netting.

7. A bed/shelter unit as set forth in claim 1 wherein each end arch comprises a tubular casing of tent fabric material at the respective end of said panel having the shape of an arch, and inflatable bladder means in the arch-shaped tubular casing, with means for entry and exit of air for inflating and deflating the bladder means.

8. A bed/shelter unit as set forth in claim 7 wherein each tubular casing has at least one opening for insertion and removal of the bladder means.

9. A bed/shelter unit as set forth in claim 8 wherein each tubular casing has closed lower ends in continuation of the lower side edges of the panel.

10. A bed/shelter unit as set forth in claim 7 wherein the panel is seamed to the end arches within the outer circumferential confines of the arches so that a fly may be applied over the tent and the arches spaced from the panel so as to provide a double-walled construction.

11. A bed/shelter unit as set forth in claim 1 wherein the mattress comprises a casing of fabric material, wherein inflatable bladder means is provided in the mattress casing for expanding it, and wherein a collapsible and expandable air pump is provided in the mattress for inflating the mattress bladder means, said pump being made of air-impervious flexible sheet material having inflation chambers adapted to be inflated for expanding the pump to provide a pump chamber, said pump having a check-valved air intake for said pump chamber and check-valved outlet means connected to the mattress bladder means, the pump, when expanded, being operable by squeezing it to pump air through the outlet means to the mattress bladder means.

12. A bed/shelter unit adapted to be compactly packed comprising:

an air mattress adapted to be inflated and deflated;

a tent on the mattress adapted to be erected as a shelter over the mattress and to be collapsed on the mattress;

said mattress, when deflated, and said tent, when collapsed on the mattress, being adapted to be compactly packed as by rolling them up into a bundle;

said tent including a panel of flexible tent material adapted to arch over the inflated mattress from one side of the mattress to the other;

said panel having lower side edges secured to the mattress at the sides of the mattress;

said lower side edges of said panel terminating short of the ends of the mattress so that the mattress has end portions at both its ends extending beyond said lower edges;

said panel having support means at each end, adjacent each end of the mattress, each said support means adapted to be erected as an arch extending over the mattress from one side of the mattress to the other with each arch, at its lower ends, being spaced inwardly from its adjacent end of the mattress;

means extending between said arches and said end portions of the mattress for holding the arches in an erected position with the panel drawn between the arches and arched over the inflated mattress, said extending means comprising an end closure at each end of the tent, each said end closure having a curved edge secured to its adjacent arch and having a lower edge extending from one side of the mattress around its respective end of the mattress to the other side of the mattress, said lower side edges of said panel and said lower side edges of the end closures being detatchably secured to the mattress by slide fastener means which extend along both sides and ends of the mattress.

13. A bed/shelter unit as set forth in claim 12 wherein the slide fastener means has inside and outside pull means.

14. A bed/shelter unit adapted to be compactly packed comprising:

an air mattress adapted to be inflated and deflated;

a tent on the mattress adapted to be erected as a shelter over the mattress and to be collapsed on the mattress;

said mattress, when deflated, and said tent, when collapsed on the mattress, being adapted to be compactly packed as by rolling them up into a bundle;

said tent including a panel of flexible tent material adapted to arch over the inflated mattress from one side of the mattress to the other;

said panel having lower side edges secured to the mattress at the sides of the mattress;

said lower side edges of said panel terminating short of the ends of the mattress so that the mattress had end portions at both its ends extending beyond said lower edges;

said panel having support means at each end adjacent each end of the mattress, each said support means adapted to be erected as an arch extending over the mattress from one side of the mattress to the other with each arch, at its lower ends, being spaced inwardly from the adjacent end of the mattress; and means extending between said arches and said end portions of the mattress for holding the arches in an erected position with the panel drawn between the arches and arched over the inflated mattress, said extending means comprising an end closure of each end of the tent;

each said end closure having a curved edge secured to its adjacent arch and having a skirt of tent fabric material extending from one side of the mattress around its respective end of the mattress to the other side of the mattress, each said skirt having an opening therein and a netting in the opening, said skirt being detachably secured to the mattress by slide fastener means which extend along both sides and ends of the mattress.

15. A bed/shelter unit as set forth in claim 14 wherein the slide fastener means comprises a first slide fastener extending from the center of one end of the mattress and the center of the lower edge of the respective end closure along said one end of the mattress to one side of the mattress, along said one side of the mattress, and along the other end of the mattress to the center of said other end of the mattress and the center of the lower edge of the other end closure, and a second slide fastener extending from the center of said one end of the mattress and the center of the lower edge of the respective end closure along said one end of the mattress to the other side of the mattress, along the other side of the mattress, and along the other end of the mattress to the center of said other end of the mattress and the center of the lower edge of the other end closure.

16. A bed/shelter unit adapted to be completely packed comprising:

an air mattress adapted to be inflated and deflated;

a tent on the mattress adapted to be erected as a shelter over the mattress and to be collapsed on the mattress;

said mattress, when deflated, and said tent, when collapsed on the mattress, being adapted to be compactly packed as by rolling them up into a bundle;

said tent including a panel of flexible tent material adapted to arch over the inflated mattress from one side of the mattress to the other;

said panel having lower side edges secured to the mattress at the sides of the mattress;

said lower side edges of said panel terminating short of the ends of the mattress so that the mattress has end portions at both its ends extending beyond said lower edges;

said panel having support means at each end adjacent each end of the mattress, each said support means adapted to be erected as an arch extending over the mattress from one side of the mattress to the other with each arch, at its lower ends, spaced inwardly from the adjacent end of the mattress; and means extending between said arches and said end portions of the mattress for holding the arches in an erected position with the panel drawn between the arches and arched over the inflated mattress, each end arch comprising a tubular casing of tent fabric material at the respective end of said panel, said casing having the shape of an arch, and inflatable bladder means in the arch-shaped tubular casing, with means for entry and exit of air for inflating and deflating the bladder means, each said tubular casing having closed lower ends in continuation of the lower side edges of the panel, with an opening adjacent each closed lower end of said tubular casing for the insertion and removal of the bladder means, and means for closing each said opening.

17. A bed/shelter unit adapted to be compactly packed comprising:

an air mattress adapted to be inflated and deflated;

a tent on the mattress adapted to be erected as a shelter over the mattress and to be collapsed on the mattress;

said mattress, when deflated, and said tent, when collapsed on the mattress, being adapted to be compactly packed as by rolling them up into a bundle;

said tent including a panel of flexible tent material adapted to arch over the inflated mattress from one side of the mattress to the other;

said panel having lower side edges secured to the mattress at the sides of the mattress;

said lower side edges of said panel terminating short of the end of the mattress so that the mattress has end portions at both its ends extending beyond said lower edges;

said panel having support means at each end adjacent each end of the mattress, each said support means adapted to be erected as an arch extending over the mattress from one side of the mattress to the other with each arch, at its lower ends, spaced inwardly from the adjacent end of the mattress; and means extending between said arches and said end portions of the mattress for holding the arches in an erected position with the panel drawn between the arches and arched over the inflated mattress, each end arch comprising a tubular casing of tent fabric material at the respective end of said panel, said casing having the shape of an arch, and inflatable bladder means in the arch-shaped tubular casing, with means for entry and exit of air for inflating and deflating the bladder means and at least one opening in each tubular casing for insertion and removal of the bladder means, the bladder means in each tubular casing comprising an inflatable tube having the shape of an arch, the means for entry and exit of air comprising a fitting extending outwardly from the inflatable tube in the direction toward the respective end of the mattress at the top of the tubular casing through an opening in the tubular casing.

18. A bed/shelter unit adapted to be compactly packed comprising:

an air mattress adapted to be inflated and deflated;

a tent on the mattress adapted to be erected as a shelter over the mattress and to be collapsed on the mattress;

said mattress, when deflated, and said tent, when collapsed on the mattress, being adapted to be compactly packed as by rolling them up into a bundle;

said tent including a panel of flexible tent material adapted to arch over the inflated mattress from one side of the mattress to the other;

said panel having lower side edges secured to the mattress at the sides of the mattress;

said lower side edges of said panel terminating short of the ends of the mattress so that the mattress has end portions at both its ends extending beyond said lower edges;

said panel having support means at each end adjacent each end of the mattress, each said support means adapted to be erected as an arch extending over the mattress from one side of the mattress to the other with each arch, at its lower ends, spaced inwardly from the adjacent end of the mattress; and means extending between said arches and said end portions of the mattress for holding the arches in an erected position with the panel drawn between the arches and arched over the inflated mattress, each arch comprising a tubular casing of tent fabric material at the respective end of said panel, said casing having the shape of an arch, and inflatable bladder means, with means for entry and exit of air for inflating and deflating the bladder means, each tubular casing comprising two strips of fabric material each having the shape of an arch superimposed one on the other and seamed along their edges to form the tubular casing, the bladder means in each tubular casing comprising two strips of heat-sealable air-impermeable plastic film each having the shape of an arch superimposed one on the other and heat-sealed along their edges to form a tube in the shape of an arch, the ends of said tube being closed by heat-sealed end seams so that the tube is inflatable.

19. A bed/shelter unit adapted to be compactly packed comprising:

an air mattress adapted to be inflated and deflated;

a tent on the mattress adapted to be erected as a shelter over the mattress and to be collapsed on the mattress;

said mattress, when deflated, and said tent, when collapsed on the mattress, being adapted to be compactly packed as by rolling them up into a bundle;

said tent including a panel of flexible tent material adapted to arch over the inflated mattress from one side of the mattress to the other;

said panel having lower side edges secured to the mattress at the sides of the mattress;

said lower side edges of said panel terminating short of the ends of the mattress so that the mattress has end portions at both its ends extending beyond said lower edges;

said panel having support means at each end adjacent each end of the mattress, each said support means adapted to be erected as an arch extending over the mattress from one side of the mattress to the other with each arch, at its lower ends, being spaced inwardly from the adjacent end of the mattress;

means extending between said arches and said end portions of the mattress for holding the arches in an erected position with the panel drawn between the arches and arched over the inflated mattress;

the lower side edges of the panel being detachably secured to the mattress by slide fastener means, the slide fastener means comprising first lengths of slide fastener tape seamed to the lower side edges of the panel and continuing on beyond the ends of said lower side edges, and second lengths of slide fastener tape seamed to the sides of the mattress; and each end arch comprising a tubular casing of fabric material at the respective end of the panel having the shape of an arch, and inflatable bladder means in the arch-shaped tubular casing, with means for entry and exit of air for inflating and deflating the bladder means, each tubular casing having its lower ends seamed to said first lengths of slide fastener tape adjacent the respective ends of said lower edges of the panel.

20. A bed/shelter unit as set forth in claim 19 wherein the lower ends of each tubular casing are seamed to said first lengths of slide fastener tape on lines extending diagonally with respect to the tubular casing such that each arched tubular casing, when erected, slants upward and outward from its lower ends in the direction toward the respective end of the mattress.

21. A bed/shelter unit as set forth in claim 20 wherein the tent has an end closure at each end, each end closure having a curved edge secured to the respective end arch and a lower edge extending from one side of the mattress around the respective end of the mattress to the other side of the mattress, said slide fastener means extending along the sides and ends of the mattress and detachably securing the lower edges of the end closures as well as the lower side edges of said panel and the lower ends of the tubular casings to the mattress.

22. A bed/shelter unit as set forth in claim 21 wherein the mattress comprises top and bottom sheets of fabric seamed together at side and end seams along the sides and ends of the mattress, the said second lengths of slide fastener tape being seamed to the sheets together with the side and end seams.

23. A bed/shelter unit adapted to be compactly packed comprising:

an air mattress adapted to be inflated and deflated;

a tent on the mattress adapted to be erected as a shelter over the mattress and to be collapsed on the mattress;

said mattress, when deflated, and said tent, when collapsed on the mattress, being adapted to be compactly packed as by rolling them up into a bundle, said mattress including a casing of fabric material and inflatable bladder means in the mattress casing for expanding the casing, said mattress casing having three partitions extending lengthwise thereof dividing it into two inner and two outer longitudinally extending cells, said partitions terminating short of one end of the casing, said bladder means comprising four inflatable tubes extending lengthwise of the mattress in said cells, the tubes in the two outer cells extending generally from one end to the other end of the mattress, the tubes in the two inner cells extending from said other end toward but terminating short of said one end of the mattress, thereby providing a compartment in the mattress casing at said one end between portions of the two outer tubes which extend beyond the inner tubes;

said tent including a panel of flexible tent material adapted to arch over the inflated mattress from one side of the mattress to the other;

said panel having lower side edges secured to the mattress at the sides of the mattress;

said lower side edges of said panel terminating short of the ends of the mattress so that the matress has end portions at both its ends extending beyond said lower edges;

said panel having support means at each end adjacent each end of the mattress, each said support means adapted to be erected as an arch extending over the mattress from one side of the mattress to the other with each arch, at its lower ends, being spaced inwardly from the adjacent end of the mattress;

means extending between said arches and said end portions of the mattress for holding the arches in an erected position with the panel drawn between the arches and arched over the inflated mattress; and a collapsible and expandable air pump disposed in said compartment in the mattress for inflating the mattress bladder means, said pump being made of air-impervious flexible sheet material having inflation chambers adapted to be inflated for expanding the pump to provide a pump chamber, said pump having a check-valved air intake for said pump chamber and check-valved outlet means connected to the mattress bladder means, the pump, when expanded, being operable by squeezing it to pump air through the outlet means to the mattress bladder means.

24. A bed/shelter unit as set forth in claim 23 wherein the pump has a tubular body and end walls at the ends of the body, the chambers extending lengthwise of the body, and a check-valved outlet in each end wall, one connected to one of the outer tubes, the other connected to the other outer tube, each outer tube being in communication with the adjacent inner tube for flow of air from one to the other.

25. A bed/shelter unit as set forth in claim 24 having air outlets for the tubes extending through openings in the mattress casing with closures for said outlets.

* * * * *